US006519505B2

(12) United States Patent
Formon

(10) Patent No.: US 6,519,505 B2
(45) Date of Patent: Feb. 11, 2003

(54) INTEGRATED DISPENSER AND BUSINESS MACHINE SYSTEM

(75) Inventor: John S. Formon, Orange Park, FL (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 09/892,793

(22) Filed: Jun. 28, 2001

(65) Prior Publication Data

US 2002/0030061 A1 Mar. 14, 2002

Related U.S. Application Data

(60) Provisional application No. 60/214,808, filed on Jun. 28, 2000.

(51) Int. Cl.[7] ..... G06F 17/00
(52) U.S. Cl. ..... 700/232; 221/9
(58) Field of Search ..... 700/231, 232, 700/240; 235/381; 221/9

(56) References Cited

U.S. PATENT DOCUMENTS 3,006,538 A 10/1961 Deutsch
3,289,929 A 12/1966 Hecker et al.
4,603,792 A 8/1986 Molineux
5,031,258 A * 7/1991 Shaw ..... 242/563
5,513,773 A 5/1996 Cargill
5,691,919 A * 11/1997 Gemmell et al. ..... 242/563
5,918,197 A 6/1999 Toussant et al.
6,318,590 B1 * 11/2001 McMurray-Stivers ..... 221/281
6,404,837 B1 * 6/2002 Thompson et al. ..... 377/13
6,412,679 B2 * 7/2002 Formon et al. ..... 225/10
6,426,701 B1 * 7/2002 Levy et al. ..... 137/552.7

* cited by examiner

*Primary Examiner*—Khoi H. Tran
(74) *Attorney, Agent, or Firm*—Banner & Witcoff, Ltd.

(57) ABSTRACT

A system for dispensing a predetermined amount of paper product to a customer based on a food order inputted into a business machine at a food service establishment. The system includes a business machine, such as a cash register, linked to a powered paper product dispenser. Each menu item available at the establishment is assigned a number that represents the total number of paper product sheets that a normal customer may need while consuming the item. This number is stored within a memory. A microprocessor contained within either the dispenser or the business machine linked to the dispenser retrieves a command from the memory when a food item key is pressed and provides a signal to the dispenser motor which in turn rotates a feed roller within the dispenser so that the predetermined number of paper product sheets are dispensed to the customer. The system controls the amount of paper product provided to the customer in order to reduce waste.

37 Claims, 4 Drawing Sheets

INTEGRATED DISPENSER AND BUSINESS MACHINE SYSTEM

RELATED APPLICATION

Benefit of the Jun. 28, 2000 filing date of U.S. Provisional Patent Application No. 60/214,808 is hereby claimed. U.S. Provisional Patent Application No. 60/214,808 is also hereby incorporated by reference.

FIELD OF THE INVENTION

The present invention relates to a method and apparatus for dispensing a paper product, more particularly it relates to a method and apparatus for automatically dispensing a predetermined amount of a paper product in response to a food order entered into a cash register or other such business machine.

BACKGROUND OF THE INVENTION

Many food service establishments such as fast food restaurants offer service at a counter or in a cafeteria setting. These establishments typically furnish paper products such as napkins, paper towels or other absorbent paper products to their customers for wiping their hands, faces, etc. These paper products are either available in dispensers located throughout the restaurant or presented to the customers at the counter when they receive their food order. Regardless of how the paper products are dispensed to the customer, these restaurants experience needless paper product waste that increases their operating costs.

When manual dispensers located throughout the restaurant are used, the management has no control over the number of paper products that each customer takes. As a result, customers can take as many as they wish. Typically, customers take more paper products, for example napkins, than they will use while eating their food order. The customer or the person cleaning the table then discards these extra, unused napkins. Alternatively, the customer may keep the extra napkins and use them elsewhere, such as in their office or automobile. As a result, perfectly clean, unused napkins are wasted or taken for purposes not related to the restaurant that paid for them.

In an attempt to prevent the waste of paper products, many restaurants have stopped using manual, customer accessible dispensers, and instead now rely on their cashiers to dispense the paper products. It was anticipated that a cashier would provide a customer with only the fewest number of napkins or sheets of paper towel necessary. Unfortunately, the cashiers do not accurately control the amount of paper product provided to the customer. Moreover, they typically do not provide a commensurate number of napkins or sheets of paper towel for the ordered food. Instead, they just reach for the stack of napkins or paper towels and provide a random number of them to the customer without considering the type of food ordered or the size of the portion. Consequently, when the cashiers are not paying attention or have poor judgment, they also can cause paper product waste by providing the customer with more than they need. Alternatively, they may upset the customers by not providing them with a sufficient number of napkins or sheets of paper towel. Additionally, by requiring the staff to dispense the paper products, the speed of the service provided to the customer is reduced. This can cause the customers to become upset and impatient while in line. Additionally, it may discourage the customers from staying in line and/or returning to the restaurant.

Powered dispensers for delivering sheets of paper products can be used. However, these dispensers supply individual sheets of rolled paper products to a user with each operation. Also, some dispensers will not deliver a second sheet until the first sheet has been removed. Additionally, they do not limit how many individual sheets a user can obtain. Instead, individual sheets will continue to be dispensed as long as the hands of the user are sensed and/or the previous sheet has been removed.

U.S. Pat. No. 3,289,929 to Hecker et al. discloses a trading or discount stamp dispenser that is controlled by a cash register. The stamp dispenser is operatively connected to the cash register and dispenses stamps that provide customers with discounts for some or all of the merchandise being sold. The face value and total number of dispensed stamps depend on the total cost of the eligible products entered into the cash register. After all of the eligible sales have been entered by the sales person, a control signal is sent from the cash register to the dispenser and stamps having an aggregate face value equal to the value of the total sale are issued to the customer. The signal provided by the cash register is only based on the total amount of the sale. As a result, the number of issued stamps is also based on the total amount of the sale. The number of issued stamps will change with the number of available denominations or the ability of the stamp dispenser to print different denominations on each stamp. For example, many stamps will need to be delivered when the face value of each stamp is low.

U.S. Pat. No. 3,006,538 to Deutsch discloses a stamp dispenser and an associated cash register. The stamp dispenser can be positioned along side or away from the cash register. The stamp dispenser can also be remotely controlled by the cash register. Like Hecker, the stamp dispenser of Deutsch issues denominational stamps equaling the total cost of the eligible goods entered into the cash register. Deutsch also discloses electronic controls that connect the cash register to the remotely positioned stamp dispenser. The cash register sends a signal to the dispenser that is based only on the monetary value of the sale. Neither Deutsch nor Hecker disclose a cash register which sends a signal to the dispenser which is based on the characteristics of the item ordered—the type of product or the size of the item ordered.

An object of the present invention includes overcoming the deficiencies of the prior art and providing a controlled amount of a paper product to a customer for limiting waste.

It is another object of the present invention to provide a paper dispenser control system which causes a paper product dispenser to deliver a precise, predetermined amount of a paper product to a customer. The predetermined amount is based on the size of the item ordered, the type of food ordered and/or the total number of items.

It is another object of the invention to provide an integrated dispenser and business machine system that will control the amount of paper product delivered to the customer without occupying the time and attention of the clerk.

Other objects of this invention will appear in the following specification and claims, reference being made now to the accompanying drawings.

SUMMARY OF THE INVENTION

An aspect of the present invention relates to a system for dispensing a predetermined amount of a paper product based on a food order inputted into a business machine at a food service establishment. The system includes a business machine, such as a cash register, linked to a powered paper product dispenser. According to the present invention, each menu item available at the establishment is assigned a number that represents the total number of napkins, sheets of paper towel or amount of other absorbent paper products that a normal customer may need while consuming the ordered item. This assigned number is stored within a memory, such as a read-only memory (ROM) or a random-access memory (RAM). A microprocessor contained within either the powered paper product dispenser or the integrated business machine retrieves a command from the memory when a food item key on the business machine is pressed. The microprocessor then provides a signal to a dispenser motor that in turn rotates a feed roller that delivers the predetermined amount of the paper product to the customer. The system controls the dispensing of the paper product in order to reduce the number of needlessly wasted unused napkins or paper towels.

DETAILED DESCRIPTION OF THE PREFERRED EMBODIMENT

Figure 1:
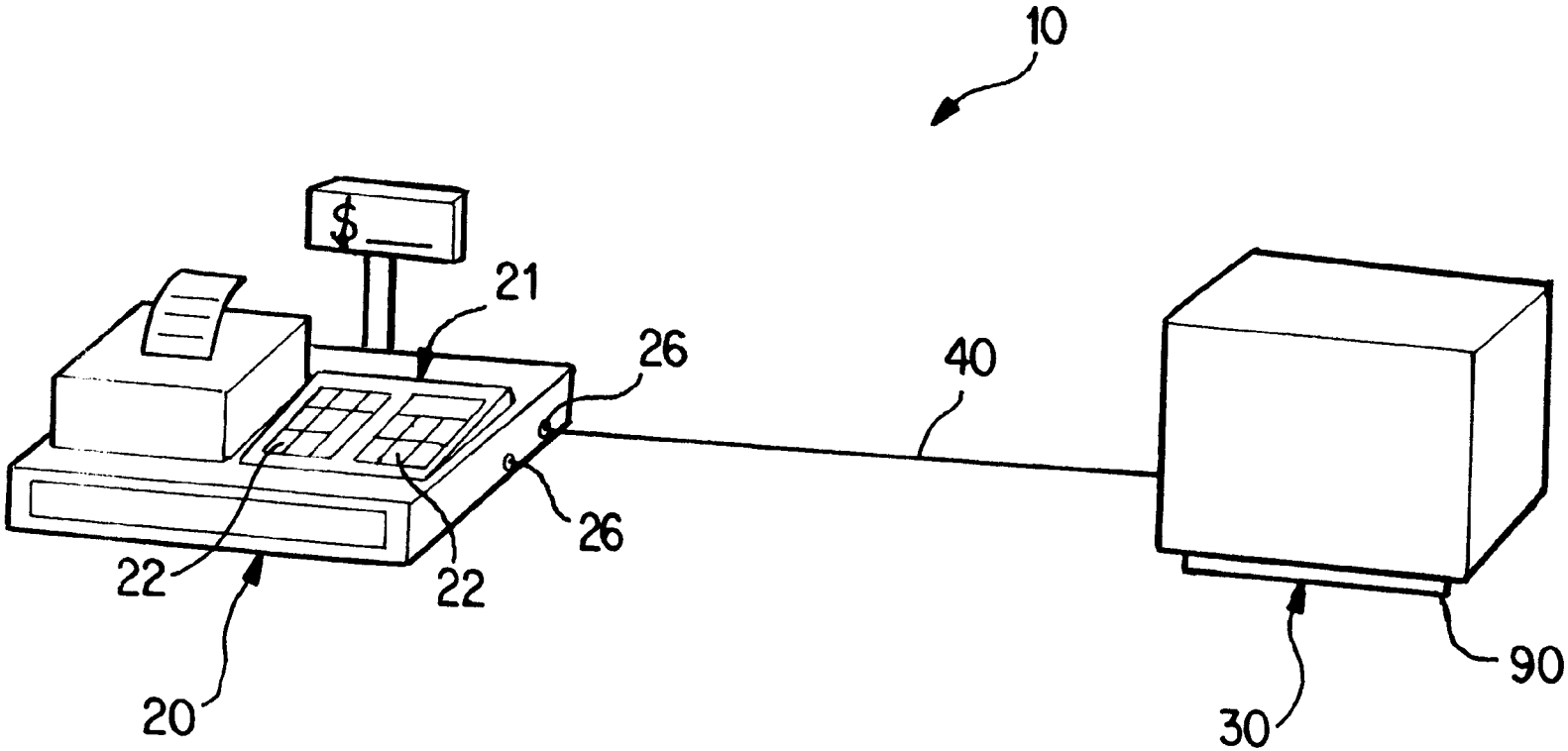
FIG. 1 is a schematic diagram of paper product dispensing system including a business machine and an automatic paper product dispenser.

FIG. 1 illustrates a schematic overview of an integrated business machine and paper product dispensing system 10 which can be used in the food service industry for delivering a predetermined amount of a paper product to a food service customer. For example, when an order for a cup of coffee is entered into the business machine, a single sheet or napkin will be dispensed. Whereas, when an order for an ice cream cone is entered, three or four sheets of paper or napkins will be dispensed.

Figure 3:
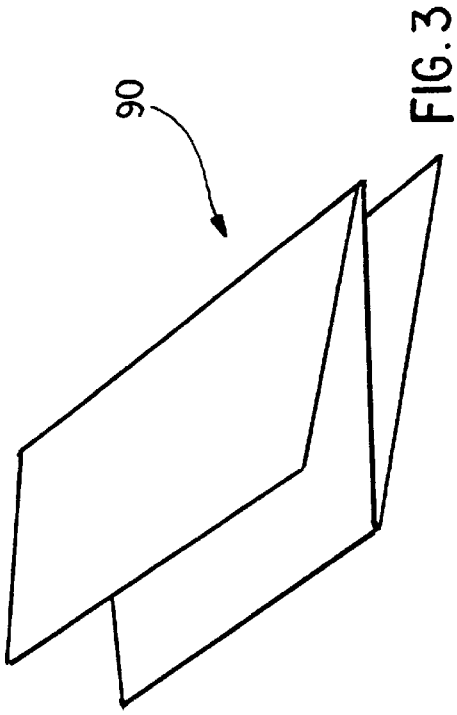
FIG. 3 is a perspective view of a type of paper product dispensed by the present invention.

These paper products can include any known absorbent paper product used in the food service industry by a customer before, during or after a meal. These absorbent paper products include rolls of paper towel sheets, stacked sheets of paper towel, stacks of folded napkins, bundles of folded napkins and rolls of folded napkins 90 which are wound on a central core, such as those formerly produced by "GP TISSUE" under the name "ROLL NAP" and illustrated in FIG. 3. Both the rolled paper towel sheets and rolled folded napkins 90 are separated by tearing lines, such as rows of prescored perforations. By using a perforated, rolled sheet material, the rolled paper products can be separated easily from the remainder of the roll along a substantially smooth edge after being dispensed. For convenience and clarity, the above-discussed paper products will be hereinafter referred to as "paper products" and each sheet or napkin will be referred to as a "paper product sheet."

System 10 includes a business machine 20, such as an electronic cash register 20, a point of sale terminal or similar machine into which a customer's food order is entered at a counter in a food service establishment. For simplicity, the following discussion will be directed to a cash register. However, the discussed principles are equally applicable to other known business machines. System 10 also includes a paper product dispenser 30 which is electronically linked to, and cooperates with, the cash register 20 for providing a predetermined number of paper product sheets to customers after their food orders have been processed.

The present invention can be used with any type of automatic paper product dispenser. However, for clarity of explanation, it will be discussed as it relates to an automatic dispenser for rolled paper products. The principles discussed below are equally applicable to other automatic paper product dispenser for rolled, stacked or otherwise arranged paper product sheets.

Figure 2:
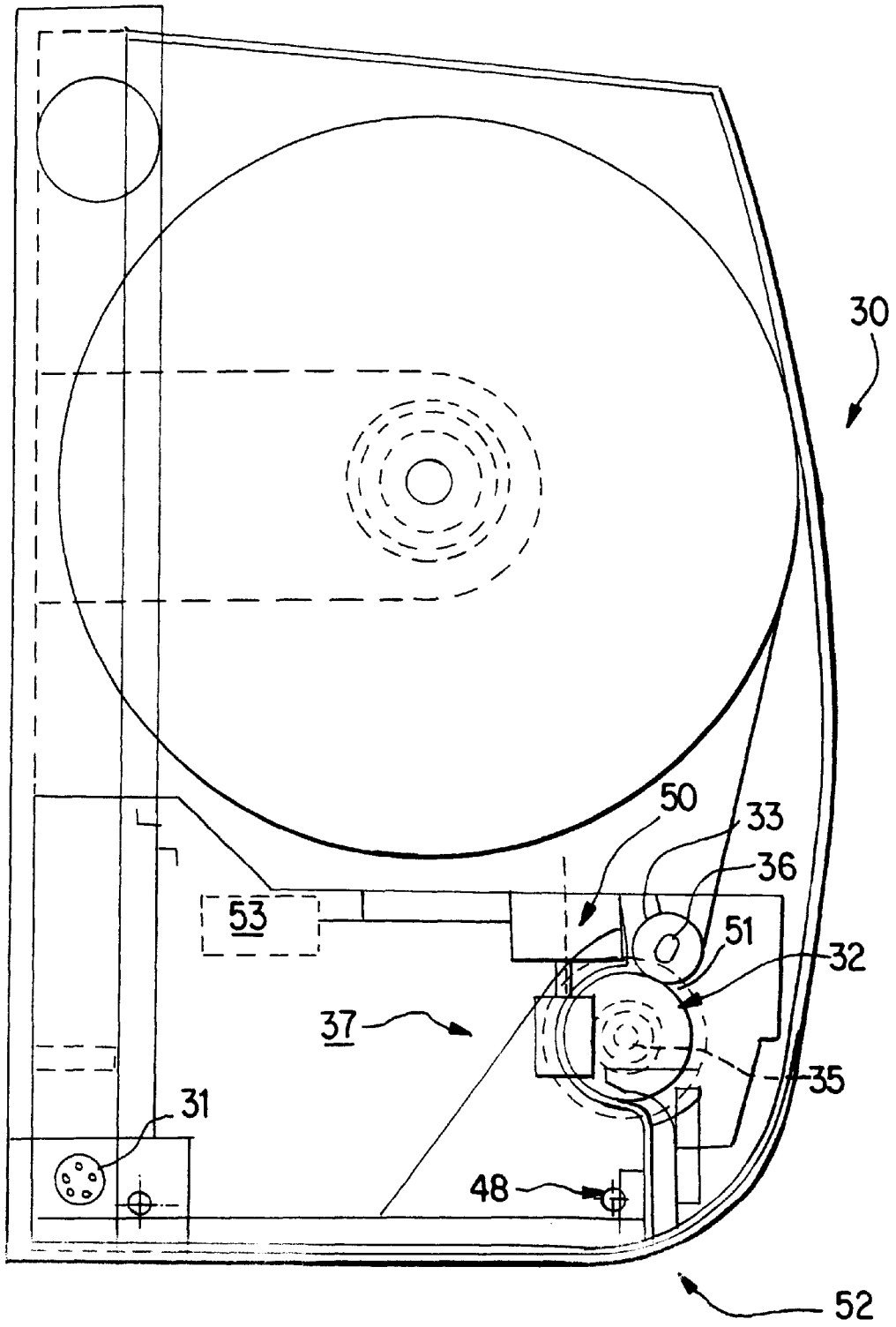
FIG. 2 is a side diagrammatic view of the dispenser of the present invention with the cover in a closed position and showing a sheet of a paper product being dispensed.

FIG. 2 illustrates a powered paper product dispenser 30 such as that disclosed in the U.S. patent application Ser. Nos. 09/081,637 and 09/453,794 to Formon et al., titled "PAPER TOWEL DISPENSER" and that disclosed in U.S. patent application Ser. No. 09/604,811 to Formon et al., titled "Paper Towel Dispenser With Powered Transfer Mechanism" filed on Jun. 28, 2000, which are all hereby expressly incorporated by reference. However, other powered paper product dispensers can also be integrated and used within the present invention. As shown in FIG. 2, the dispenser 30 includes a feed mechanism 37 mounted within a housing to deliver the paper product sheets in single or multiple incremental segments. In a preferred construction, feed mechanism 37 includes a feed roller 32 and a pressure roller 33 which are respectively mounted on axles 35, 36. In use, feed roller 32 is driven by an electric motor 50 mounted within the dispenser 30. When the paper product is fed into a nip 51, rotation of the feed roller 32 causes the paper product sheet to be advanced through a discharge opening 52 in the housing.

In order to control the amount of paper product fed so that the proper amount is delivered, dispenser 30 employs a length detector 48 (shown in FIG. 2) that establishes the amount of paper product fed during the dispensing cycle, each time the motor 50 is activated. The length detector 48 may be, for example, an encoder, either electromechanical or optical, that outputs a pulse for each increment of paper product to be dispensed. The encoder can be programmed to make any number of counts per revolution. For example, the encoder could be designed to make 32 counts per revolution. The length detector 48 may be coupled to a microprocessor 53 or a logic circuit 54 used to control the operation of the motor 50 and feed roller 32. An alternative to encoding the successive incremental displacements of the paper product sheets is to detect the difference in transmissivity of the paper product when a perforation line crosses an optical interrupter as discussed in the above mentioned U.S. Patent Applications to Formon et al. which are incorporated by reference.

When an encoder is employed to dispense the proper amount of paper product, the microprocessor 53 may count the number of pulses generated by the length detector 48 and continue to operate the motor 50 until the proper number of pulses has been counted. For example, when the perforation lines are four inches apart for each napkin on the roll and the signal for dispensing three napkins has been provided to the microprocessor 53, the microprocessor 53 will operate the motor 50 and the feed roller 32 until the number of pulses that correspond to twelve inches of the paper product are counted. As used herein, the term "microprocessor" includes both microprocessors and microcontrollers. Microcontrollers useable as microprocessor 53 are available from PIC. The specific microcontroller used will depend on the specific requirements of the dispenser. These requirements can include the Input/Output pins and the amount of memory needed.

Because different forms of paper products have different sheet lengths when rolled on a core, the length of the dispensing cycle and the appropriate number of pulses for dispensing a single sheet will also differ. Therefore, the dispenser 30 can be adjusted so that different rolls of products can be accurately delivered to the customers. For example, a dispenser which is setup to dispense a rolled paper towel that is nine inches between perforation rows can be adjusted to accurately dispense folded napkins 90 which are rolled on a core with only four inches between each row of perforations. The adjustment for accommodating a different size paper product can be inputted by a dial, a switch, a button or other known means so that the microprocessor will count the predetermined number of pulses for the length and number of sheets of the fed product and deliver the proper number of sheets to the customer.

As shown in FIG. 1, the cash register 20 according to the present invention includes a keypad 21 with individual function, numeric and/or menu item keys 22. Each of these keys 22 is mapped or otherwise linked to a program in a memory 23, such as a RAM or a ROM, as is known in conventional cash register technology. The program in memory 23 includes a list of different information or commands that are assigned to each of the keys. These commands may include the price of the item, the name of the item and a predetermined number of paper product sheets to be dispensed to the customer that is based on its size and/or food type. As used herein, "food" includes both solid and liquid food. For example, a regular hamburger may be assigned the number "1" (or a corresponding number of pulses) which means that the dispenser 30 will only be operated long enough to deliver one sheet of the paper product to the customer. Whereas, a triple cheeseburger with many toppings will be assigned the number "3" (or a corresponding number of pulses). The number "3" means that three sheets of paper product will be delivered to the customer. Also, the "jumbo size" of a menu item may be assigned more sheets than the standard size of the same menu item. The assigned number for each item is inputted into the memory 23 or another memory within the system 10, such as a memory chip in the dispenser 30, before the item is introduced into the menu. Other commands can also be assigned to each key and stored within one of these memories.

Figure 4:
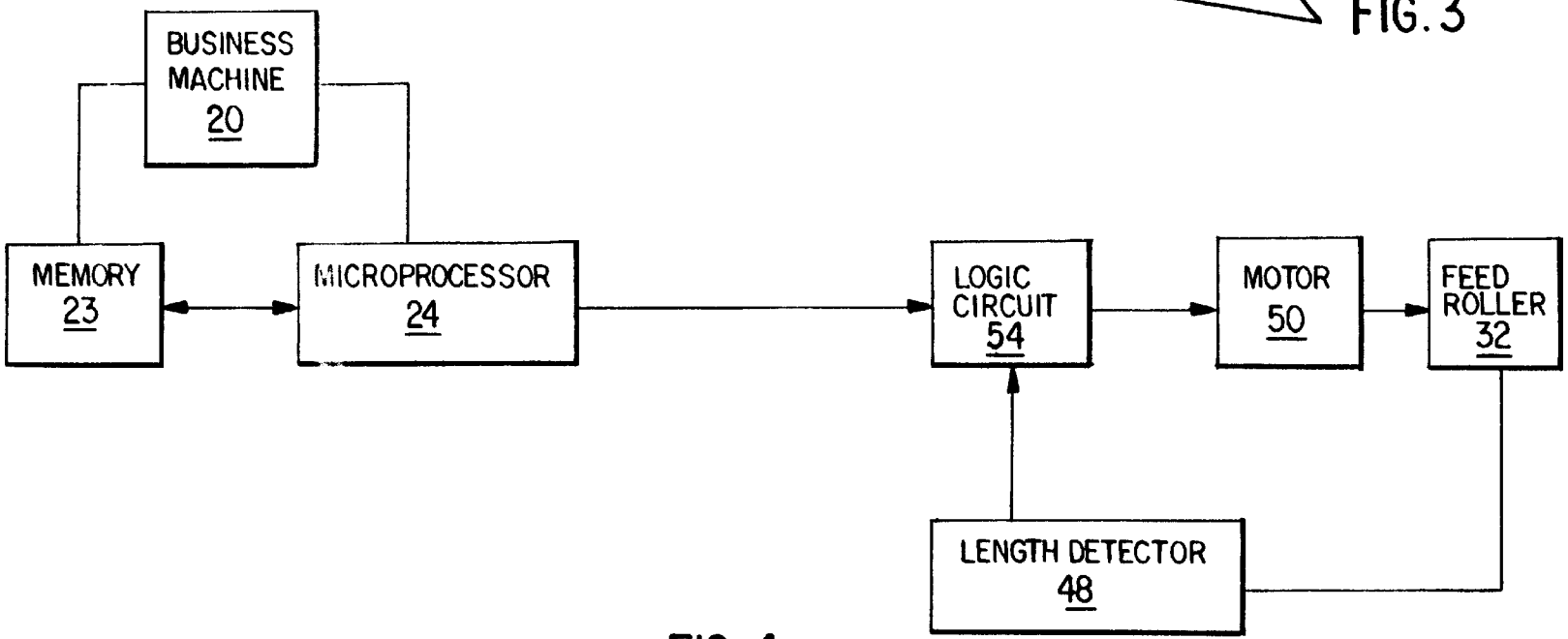
FIG. 4 is block diagram of the paper product dispensing system coupled to a business machine according to a first embodiment of the present invention.
Figure 5:
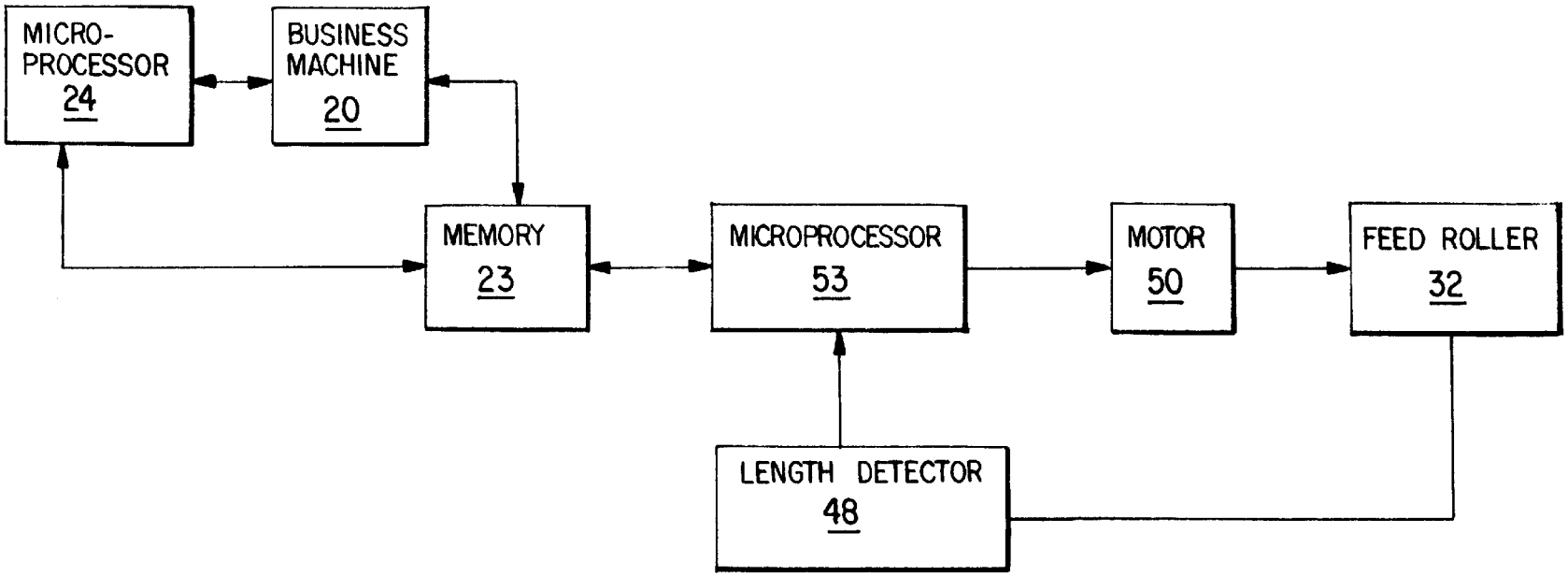
FIG. 5 is a block diagram of the paper product dispensing system coupled to a business machine according to a second embodiment of the present invention.

As illustrated in FIG. 4, the cash register 20 also includes a well-known microprocessor 24 that receives the assigned information for a depressed key from the memory 23 and sends a signal or data to an appropriate location within the restaurant via a RS-232 data port 26 or a network port on the cash register 20. For example, the microprocessor 24 can send the stored data concerning the price of the item to another memory chip in the cash register 20; it can send the name and other information about the item to a food preparation station so that the order can be filled. The microprocessor 24 contained within the cash register 20 can also send a signal or data to the dispenser 30 via a data transfer line 40 or remote control using known sensors, such as infrared sensors. Data transfer line 40 extends from a RS-232 data port on the cash register 20 to a similar port 31 on the dispenser 30. The signal or data from microprocessor 24 can be interpreted by the microprocessor 53, or it can carry commands to the logic circuit 54 within the napkin dispenser 30 that cause the activation of the motor 50 and the delivery of the predetermined number of paper product sheets to the customer.

In operation, when a customer orders a particular menu item, the corresponding key on the cash register 20 is pressed. The microprocessor 24 within the cash register 20 responds by executing a software routine. Initially, the microprocessor 24 utilizes the identification of the particular key that was pressed to access a table within a memory that contains the information about that ordered item. This information concerning the predetermined number of paper product sheets that are to be delivered is then accessed and interpreted by the microprocessor 24. The information is then sent to the microprocessor 53 or the logic circuit 54 within dispenser 30. Typically, the stored information concerning the number of paper product sheets to deliver will be in the form of how many pulses should be delivered to the dispenser motor 50 in order to dispense the predetermined amount of paper product. As discussed above, the predetermined number of pulses can correspond to the distance between rows of perforations for the specific product being dispensed.

The microprocessor 53 (or logic circuit 54) is connected to the motor 50 and controls its operation. The microprocessor 53 sends an activation signal to the motor 50 and instructs it to drive the feed roller 32. The motor 50 and feed roller 32 continue to operate and cause the paper product to be dispensed until the predetermined number of pulses have been counted, such as by the length detector 48. When the predetermined number of pulses has been counted, the motor 50 and the feed roller 32 are stopped and the dispensed number of sheets are torn off and provided to the customer. The motor 50 can also be operated in a reverse direction so that any dispensed sheets that are not torn from the roll can be returned into the dispenser 30 so that they are not needlessly soiled or ripped. The motor 50 and feed roller 32 will then remain at rest until another menu item has been selected, and information for that selection has been provided. It is also contemplated that the amount of paper product for each selected item be stored in a memory and the total amount of paper product for the ordered items be dispensed at a single time after the order has been completed, not after each item has been individually entered, as discussed above.

Both of the microprocessors 24, 53 operate in a conventional manner. Specific implementations of these microprocessors are well known to those skilled in the art, and include for example, integrated circuits manufactured by INTEL. The microprocessors can be functionally connected to a memory chip; program controls for the microprocessors are stored in the memory.

The above-described invention relates to a method and device for dispensing a preset amount of a paper product that is based on the menu items ordered. The number of paper product sheets that are dispensed with each of the above-discussed food items is merely exemplary and does not limit the invention. While the invention has been described in the manner presently conceived to be most practical and a preferred embodiment thereof, it will be apparent to persons ordinarily skilled in the art that modifications may be made thereof within the scope of the invention, which scope is to be accorded the broadest interpretation of the claims such as to encompass all equivalents, devices, and methods. For example, the microprocessor and memory that stores all of the information concerning the number of sheets to dispense can both be located within the dispenser 30. In this embodiment, the microprocessor 24 would merely send a signal to the microprocessor 53 that contains the name of the ordered item. The microprocessor 53 would then access a memory chip in the dispenser 30 and obtain the information regarding the number of sheets that should be dispensed and/or the related number of pulses that should be counted. The microprocessor would then drive the motor 50 for the proper length of time so that the predetermined number of sheets was dispensed. The operation and timing of the motor 50 and the other parts of the invention would be the same as discussed above.

I claim:

1. A method for dispensing paper products including the steps of:

a) assigning a predetermined amount of paper product to at least one menu item;

b) entering a food service order into a business machine;

c) processing said food service order;

d) providing information about said food service order from said business machine to a dispenser;

e) providing a motor within the dispenser with a command to dispense the predetermined amount of the paper product;

f) operating said motor and dispensing the predetermined amount of paper product from the dispenser in response to said entered food order.

2. The method according to claim 1 further including the steps of accessing a memory and obtaining information about the predetermined amount of paper product for each ordered item, and wherein said obtained information is in addition to that provided from said business machine.

3. The method according to claim 1 further including the steps of sensing when the predetermined amount of paper product has been dispensed and stopping the motor.

4. The method according to claim 1 further including the step of linking the business machine to the dispenser using a data cable.

5. A business machine for processing food service orders in combination with a powered paper product dispenser, said business machine being linked to said dispenser so that said dispenser delivers a predetermined amount of a paper product in response to the size or type of food item ordered.

6. A business machine in combination with an automatic paper product dispenser:

said business machine including an entry system for entering a food order;

an automatic paper product dispensing device connected to said business machine for receiving a signal from said business machine in response to an entered food order, said dispenser including a feed roller connected to a motor for automatically dispensing a predetermined amount of paper product for each item on a menu based on the size or type of food ordered; and said combination including a processor for providing said motor with a signal based on the predetermined amount of paper product assigned to an ordered item so that the motor will only power the feed roller long enough to dispense the predetermined amount of paper product.

7. The combination according to claim 6 wherein said business machine includes a cash register.

8. The combination according to claim 6 wherein said dispenser includes a sensor for determining the amount of paper product that has been dispensed.

9. The combination according to claim 6 wherein said microprocessor is located within said cash register.

10. The combination according to claim 6 wherein said microprocessor is located within said dispenser.

11. The combination according to claim 6 further comprising a memory for storing information regarding said predetermined amount of paper product to be dispensed for items on a food menu.

12. A business machine in combination with an automatic napkin dispenser for dispensing a predetermined number of napkins in response to a food order received by said business machine.

13. The combination of claim 12 wherein said business machine including an entry system for entering said food order.

14. The combination of claim 12 wherein said business machine is connected to said dispenser for delivering a signal to said dispenser in response to said food order.

15. The combination of claim 12 wherein said dispenser comprises a feed roller connected to a motor for automatically dispensing a predetermined number of napkins for each item on a menu based on the size or type of food ordered.

16. The combination of claim 15 wherein said combination further comprises a processor for providing said motor with a signal based on the predetermined number of napkins assigned to an ordered item.

17. The combination of claim 12 wherein said business machine comprises a cash register.

18. The combination of claim 12 wherein said napkin dispenser includes a sensor for determining the number of napkins that have been dispensed.

19. A business machine in combination with an automatic paper towel sheet dispenser for dispensing a predetermined amount of paper towel sheet in response to a food size order and/or to a food type order received by said business machine.

20. The combination of claim 19 wherein said business machine comprises a cash register.

21. The combination of claim 19 wherein said business machine is connected to said paper towel sheet dispenser for delivering a signal to said paper towel sheet dispenser based on a food portion size and type of food in a food order.

22. The combination of claim 19 wherein said dispenser comprises a feed roller connected to a motor for automatically dispensing a predetermined number of paper towel sheets for each item on a menu based on the portion size and/or type of food ordered.

23. The combination of claim 22 wherein said combination further comprises a processor for providing said motor with a signal based on the predetermined number of paper towel sheets assigned to an ordered item.

24. The combination of claim 19 wherein said paper towel sheet dispenser includes a sensor for determining the number of paper towel sheets that have been dispensed.

25. The combination of claim 19 further comprising a memory for storing information regarding a predetermined number of paper towel sheets to be dispensed for items on a food menu.

26. A business machine in combination with an automatic, absorbent paper product dispenser for dispensing a predetermined amount of absorbent paper product in response to a food size order and/or to a food type order received by said business machine.

27. The combination of claim 26 wherein said business machine comprises a cash register.

28. The combination of claim 27 wherein said cash register is connected to said dispenser for delivering a signal to said dispenser based on a food portion size and type of food in a food order.

29. The combination of claim 26 further comprising a memory for storing information regarding a predetermined amount of absorbent paper product to be dispensed for items on a food menu.

30. The combination of claim 28 wherein said dispenser comprises a feed roller connected to a motor for automatically dispensing a predetermined amount of absorbent paper product for each item on the food menu.

31. The combination of claim 30 wherein said combination further comprises a processor for providing said motor with a signal based on the predetermined amount of absorbent paper product assigned to an ordered item.

32. The combination of claim 31 wherein said dispenser includes a sensor for determining the amount of absorbent paper product that has been dispensed in response to a signal received from said business machine.

33. A method of dispensing a predetermined number of paper product sheets, said method including the steps of:

(a) inputting a food order into a business machine;

(b) operating an automatic paper product dispenser; and (c) dispensing a predetermined number of paper product sheets, said predetermined number of sheets being based on the type of food ordered and the size of the food portion ordered.

34. The method of claim 33 further including the step of separating the dispensed paper product from the dispenser.

35. The method of claim 33 further including the steps of generating a signal within the business machine based on the inputted food order and delivering said signal to said paper product dispenser.

36. The method of claim 35 further comprising the step of the dispenser receiving the generated signal from the business machine, and wherein said operating step includes activating a dispenser motor in response to the dispenser receiving said generated signal from said business machine.

37. The method of claim 36 wherein said dispenser motor is operated until the predetermined number of paper product sheets is dispensed.

* * * * *